US006236157B1

(12) United States Patent
Pan et al.

(10) Patent No.: US 6,236,157 B1
(45) Date of Patent: May 22, 2001

(54) TAILORED SPACER STRUCTURE COATING

(75) Inventors: Lawrence S. Pan, Los Gatos; Donald R. Schropp, Jr., San Jose, both of CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/258,502

(22) Filed: Feb. 26, 1999

(51) Int. Cl.[7] ..... H01J 1/62; H01J 63/04; H01J 1/88; H01J 19/42; H01J 1/78

(52) U.S. Cl. ..... 313/495; 313/292; 313/496; 313/497; 313/422

(58) Field of Search ..... 313/238, 243, 313/250, 253–59, 268, 274, 276, 284–86, 288–89, 292, 244–46, 266, 290, 309, 336, 351, 422, 495, 497; 315/169.4; 220/445–47; 445/24, 50–51; 345/7, 98; 364/708.1; 455/566; 438/630

(56) References Cited

U.S. PATENT DOCUMENTS

| | | | | |
|---|---|---|---|---|
| 5,614,781 | * | 3/1997 | Spindt et al. | 313/422 |
| 5,675,212 | * | 10/1997 | Schmid et al. | 313/495 X |
| 5,709,577 | | 1/1998 | Jin et al. | 445/24 |
| 5,726,529 | | 3/1998 | Dean et al. | 313/495 |
| 5,772,485 | | 6/1998 | Jeng et al. | 445/24 |
| 5,776,540 | | 7/1998 | Chadha et al. | 427/126.3 |
| 5,811,927 | | 9/1998 | Anderson et al. | 313/495 |
| 5,821,911 | * | 10/1998 | Jachimowicz | 345/7 |
| 5,831,384 | | 11/1998 | Potter | 313/512 |
| 5,844,824 | * | 12/1998 | Newman et al. | 364/708.1 |
| 5,847,515 | | 12/1998 | Lee et al. | 315/169.1 |
| 5,850,123 | | 12/1998 | Potter | 313/512 |
| 5,867,795 | * | 2/1999 | Novis et al. | 455/566 |
| 5,872,424 | * | 2/1999 | Spindt et al. | 313/495 |
| 5,945,972 | * | 8/1999 | Okumura et al. | 345/98 |
| 5,956,611 | * | 10/1999 | Cathey, Jr. et al. | 438/630 |

* cited by examiner

*Primary Examiner*—Nimeshkumar D. Patel
*Assistant Examiner*—Mack Haynes
(74) *Attorney, Agent, or Firm*—Wagner, Murabito & Hao LLP

(57) ABSTRACT

In a field emission display device, a spacer assembly and a method for forming a spacer assembly. In one embodiment, the present invention is comprised of a spacer wall which has a specific secondary electron emission coefficient function associated therewith. In the present embodiment, a coating material is then applied to at least a portion of the spacer wall. In this embodiment, the coating material has a secondary electron emission coefficient function which is different than the secondary electron emission coefficient function of the spacer wall. In so doing, the present embodiment provides a spacer assembly having a plurality of secondary electron emission coefficient functions associated therewith.

34 Claims, 7 Drawing Sheets

TAILORED SPACER STRUCTURE COATING

TECHNICAL FIELD

The present claimed invention relates to the field of flat panel displays. More specifically, the present claimed invention relates to a coating material for a spacer structure of a flat panel display.

BACKGROUND ART

In some flat panel displays, a backplate is commonly separated from a faceplate using a spacer structure. In high voltage applications, for example, the backplate and the faceplate are separated by spacer structures having a height of approximately 1–2 millimeters. For purposes of the present application, high voltage refers to an anode to cathode potential greater than 1 kilovolt. In one embodiment, the spacer structure is comprised of several strips or individual wall structures each having a width of about 50 microns. The strips are arranged in parallel horizontal rows with each strip extending across the width of the flat panel display. The spacing of the rows of strips depends upon the strength of the backplate and the faceplate and the strips. Because of this, it is desirable that the strips be extremely strong. The spacer structure must meet a number of intense physical requirements. A detailed description of spacer structures is found in commonly-owned co-pending U.S. patent application Ser. No. 08/683,789 by Spindt et al. entitled "Spacer Structure for Flat Panel Display and Method for Operating Same". The Spindt et al. application was filed Jul. 18, 1996, and is incorporated herein by reference as background material.

In a typical flat panel display, the spacer structure must comply with a long list of characteristics and properties. More specifically, the spacer structure must be strong enough to withstand the atmospheric forces which compress the backplate and faceplate towards each other. Additionally, each of the rows of strips in the spacer structure must be equal in height, so that the rows of strips accurately fit between respective rows of pixels. Furthermore, each of the rows of strips in the spacer structure must be very flat to insure that the spacer structure provides uniform support across the interior surfaces of the backplate and the faceplate.

The spacer structure must also have good stability. More specifically, the spacer structure should not degrade severely when subjected to electron bombardment. As yet another requirement, a spacer structure should not significantly contribute to contamination of the vacuum environment of the flat panel display or be susceptible to contamination that may evolve within the tube.

In some conventional prior art spacer structures, a spacer wall is completely covered with a coating. However, in such prior art spacer structures, the coating material is not tailored for the variation in energy of the electrons which may potentially strike the spacer structure. That is, electrons impinging on the spacer structure near the cathode have an energy which is typically much less than the energy of electrons which strike the spacer structure near the anode. As a result of the variation in energy of impinging electrons, the secondary emission coefficient function of the wall will also vary significantly from the portion of the spacer structure near the cathode to the portion of the spacer structure near the anode.

Thus, need exists for a spacer structure which is at least partially coated with a material tailored for the variation in energy of the electrons which may potentially strike the spacer structure. A further need exists for a spacer structure which meets the above need and which does not degrade severely when subjected to electron bombardment. Still another need exists for a spacer structure which does not significantly contribute to contamination of the vacuum environment of the flat panel display or be susceptible to contamination that may evolve within the tube.

DISCLOSURE OF THE INVENTION

The present invention provides a spacer structure which is at least partially coated with a material tailored for the variation in energy of the electrons which may potentially strike the spacer structure. The present invention further provides a spacer structure which accomplishes the above achievement and which does not degrade severely when subjected to electron bombardment. The present invention further provides a spacer structure which accomplishes both of the above-listed achievements and which does not significantly contribute to contamination of the vacuum environment of the flat panel display or be susceptible to contamination that may evolve within the tube.

In one embodiment, the present invention is comprised of a spacer wall which has a specific secondary electron emission coefficient function associated therewith. In the present embodiment, a coating material is then applied to at least a portion of the spacer wall. In this embodiment, the coating material has a secondary electron emission coefficient function which is different than the secondary electron emission coefficient function of the spacer wall. In so doing, the present embodiment provides a spacer assembly having a plurality of secondary electron emission coefficient functions associated therewith.

In another embodiment, the present invention include the features of the above-described embodiment and further recites applying a second coating material applied to at least a first portion of the spacer assembly. In this embodiment, the second coating material has a secondary electron emission coefficient function which is different than the secondary electron emission coefficient function of the spacer wall and which is also different than the secondary electron emission coefficient function of the first coating material.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention. Additionally, although the following discussion specifically mentions spacer walls, it will be understood that the present invention is also well suited to the use with various other support structures including, but not limited to, posts, crosses, pins, wall segments, T-shaped objects, and the like.

Figure 1:
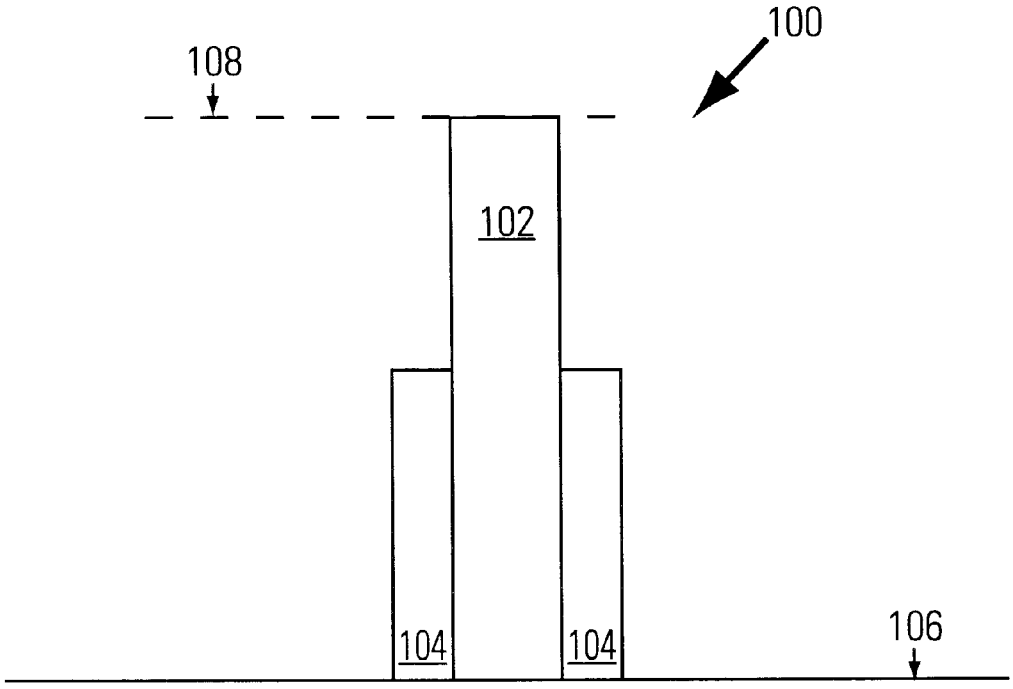
FIG. 1 is a side schematic view of a spacer assembly in which a spacer wall has a coating material applied to a portion thereof in accordance with one embodiment of the present claimed invention.

Referring now to FIG. 1, a schematic side sectional view of a spacer assembly 100 in accordance with one embodiment of the present invention is shown. In the present embodiment, spacer assembly 100 is comprised of a spacer wall 102 having a coating 104 applied to a portion thereof In the embodiment of FIG. 1, spacer wall 102 is comprised of a combination of materials. More specifically, in the present embodiment spacer wall 102 is comprised of approximately 30 percent chromium oxide ($Cr_2O_3$), approximately 70 percent alumina ($Al_2O_3$), with a small amount of titanium (Ti) added as well. Although spacer wall 102 is comprised of such a mixture in the present embodiment, the present invention is also well suited to spacer walls having various other compositions or component ratios. Typically, spacer wall 102 will have a length (from cathode to anode) of 1.25 millimeters, and a width of 50 microns.

With reference still to FIG. 1, a coating material 104 is applied to a portion of spacer wall 102. In the present embodiment coating material 104 is comprised of $Cr_2O_3$ with approximately 3 percent titanium. Furthermore, in the present embodiment, coating material 104 is applied to spacer wall 102 with a thickness of approximately a few hundred Angstroms. It is within the scope of the present invention, however, to vary the thickness of coating material 104. As shown in FIG. 1, in the present embodiment, coating material 104 is applied to the lower portion of spacer wall 102 near where spacer wall 102 is coupled to the cathode, shown as 106, of the field emission display device. Furthermore, in this embodiment, coating material 104 is not applied to spacer wall 102 near where spacer wall 102 is coupled to the anode, shown as 108, of the field emission display device. While in the present embodiment, coating material 104 is comprised of $Cr_2O_3$ with approximately 3 percent titanium, the present invention is also well suited to the use of various other coating materials which satisfy the conditions set forth below. Additionally, although coating material 104 is applied to the lower portion of spacer wall 102 as shown in FIG. 1, the present invention is well suited to various other configurations in which coating material 104 is applied to various other portions of spacer wall 102.

Figures 2A, 2B, 2C:
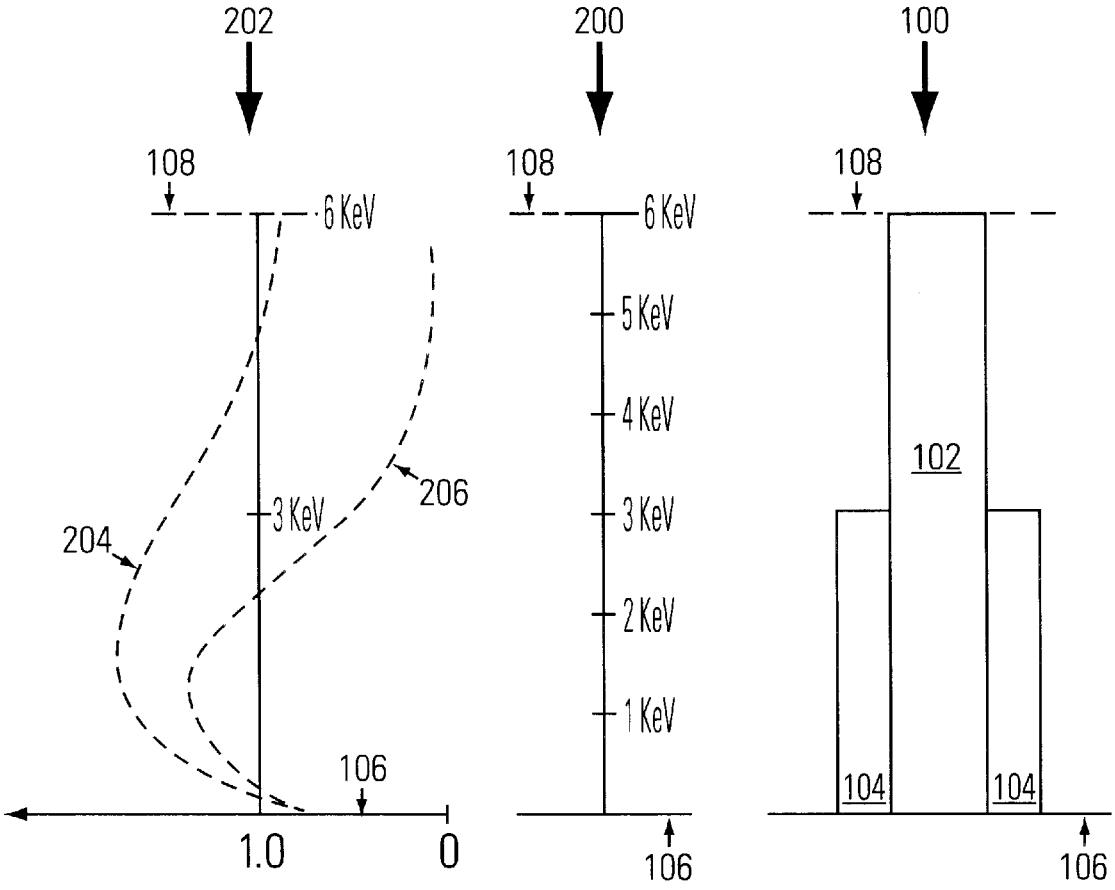
FIGS. 2A–2C are a set of Figures comparing secondary electron emission coefficient function ($\delta$), impinging electron energies, and spacer assembly height for the spacer assembly of FIG. 1 in accordance with one embodiment of the present claimed invention.

With reference now to FIGS. 2A–2C, a comparison between secondary emission coefficient function (δ), impinging electron energies, and spacer assembly height for the spacer assembly of FIG. 1 is shown. In a conventional field emission display device, electrons are accelerated from the cathode 106 towards the anode 108 using an increasing voltage potential. More specifically, the potential is at approximately 0 keV near the cathode 104 of the field emission display device. Thus, in the present invention, the voltage potential is at approximately 0 keV near the base of spacer assembly 100. The voltage potential is gradually increased to a value of approximately 6 keV near the anode 108 of the field emission display device. Thus, in the present invention, the voltage potential is at approximately 6 keV near the top of spacer assembly 100. This increasing voltage potential is graphically illustrated in FIG. 2B which plots voltage potential values between cathode 106 and anode 108. It will be understood that electrons which strike spacer assembly 100 of the present embodiment will have an energy approximately equivalent to the voltage potential at that point. Thus, as can be determined by comparing FIG. 2B with FIG. 2A, in the present embodiment, coating material 104 extends from the base of spacer wall 102 to approximately the point where electrons impinging spacer assembly 100 would have an energy of approximately 3 keV.

Referring now to FIG. 2C, a graph 202 of secondary electron emission coefficient function (δ) is shown. In graph 202 of FIG. 2C, line 204 represents the secondary emission coefficient function for a bare spacer wall 102 of FIGS. 1 and 2A between 0 keV and 6 keV. Line 206 represents the secondary emission coefficient function for coating material 104 of FIGS. 1 and 2A between 0 keV and 6 keV. In order for a spacer assembly 100 to remain "electrically invisible" (i.e. not deflect electrons passing from the row electrode on the backplate (cathode 106) to pixel phosphors on the faceplate (anode 108)), the secondary electron emission coefficient function must be kept at or near the value of 1. As shown by line 204 of FIG. 2C, the secondary electron emission coefficient function for bare spacer wall 102 is much greater than 1.0 when the incident electron energy is between approximately 0 keV and less than 3 keV. However, the secondary electron emission coefficient function for bare spacer wall 102 is fairly close to a value of 1.0 when the incident electron energy is between approximately greater than 3 keV to a value of 6 KeV. Conversely, as shown by line 206 of FIG. 2C, the secondary electron emission coefficient function for coating material 104 of FIGS. 1 and 2A is fairly close to a value of 1.0 when the incident electron energy is between approximately 0 keV and less than 3 keV. However, the secondary electron emission coefficient function for coating material 104 is much less than 1.0 when the incident electron energy is between approximately greater than 3 keV to a value of 6 KeV.

Thus, the present embodiment compensates for the variation in energy of the electrons which may potentially strike the spacer assembly 100 by coating the lower portion of spacer wall 102 with coating material 104 and leaving the upper portion of spacer wall 102 uncoated or "bare". As a result, the secondary electron emission coefficient function of spacer assembly 100 is at or near a value of 1.0 at the lower portion thereof (due to the presence of coating material 104), and the secondary electron emission coefficient function of spacer assembly 100 is at or near a value of 1.0 where desired along the upper portion thereof (due to the presence of bare spacer wall 102). As a result, spacer assembly 100 of the present embodiment has a plurality of secondary electron emission coefficient functions associated therewith. Moreover, the present embodiment tailors the secondary electron emission coefficient function of spacer assembly 100 by coating a portion of spacer wall 102 with a coating material 104.

In addition to providing an "electrically invisible" spacer assembly 100 by tailoring the secondary electron emission coefficient function to have a value close to 1.0 where desired, the present invention has several other advantages associated therewith. As one example, by not significantly collecting excess charge, the present invention eliminates the need for sophisticated, difficult to manufacture, and expensive features such as electrodes or other devices necessary in some conventional spacer walls to bleed off excess charge. Hence, the present invention can be easily and inexpensively manufactured. Additionally, because spacer assembly 100 of the present embodiment reduces charge accumulation, less charge is present to be drained from the spacer wall. As a result, resistivity specifications for the bulk spacer wall 102 (and coating material 104) can be significantly relaxed. Such relaxed specifications/requirements reduce the cost of spacer wall 102 and coating material 104. Thus, the present invention can reduce manufacturing costs.

Also, manufacturing of a spacer assembly in accordance with the present embodiment has distinct advantages associated therewith. For example, in the embodiment of FIG. 2A, the location of coating material 104 on spacer wall 102 can be altered slightly without dramatically compromising the benefits associated with the present invention. As a result, manufacturing tolerances can be loosened enough to significantly reduce manufacturing costs without severely compromising performance.

As yet another advantage, spacer assembly 100 has good stability. That is, in addition to tailoring the secondary electron emission coefficient function to a value of near 1.0 along the entire length thereof, spacer assembly 100 does not degrade severely when subjected to electron bombardment. By not degrading, spacer assembly 100 does not significantly contribute to contamination of the vacuum environment of the field emission display device. Additionally, the materials comprising spacer assembly 100 of the present embodiment (i.e. $Cr_2O_3$, $Al_2O_3$, and Ti in spacer wall 102 and $Cr_2O_3$ in coating material 104) can easily have contaminant carbon removed or washed therefrom prior to field emission display sealing processes. Also, the materials comprising spacer assembly 100 of the present embodiment do not deleteriously collect carbon after the field emission display seal process. As a result, the present embodiment is not subject to the carbon-related contamination effects associated with conventional uncoated spacer walls.

Figure 3:
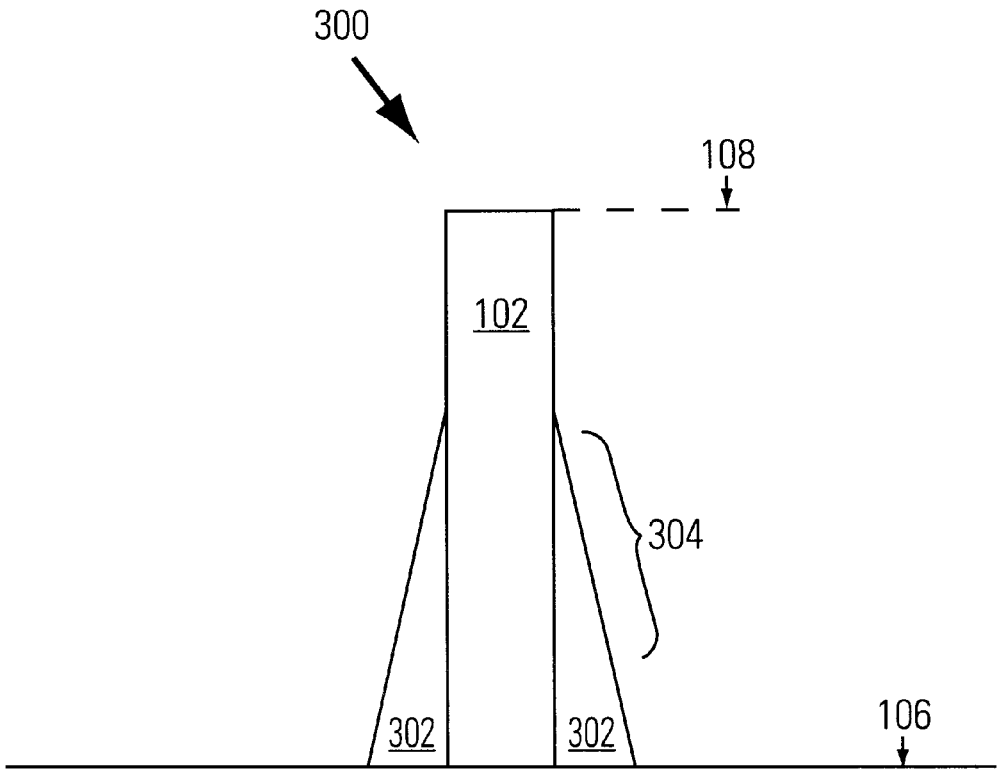
FIG. 3 is a side schematic view of a spacer assembly in which a spacer wall has a coating material of varying thickness applied to a portion thereof in accordance with one embodiment of the present claimed invention.

With reference now to FIG. 3, another embodiment of a spacer assembly 300 in accordance with the present claimed invention is shown. As in the embodiment of FIG. 1 and FIG. 2A, in this embodiment, spacer assembly 300 is comprised of a spacer wall 102 having a coating 302 applied to a portion thereof In the embodiment of FIG. 3, spacer wall 102 is comprised of the same materials described in detail above in conjunction with the embodiment of FIGS. 1 and 2A. However, the present invention is also well suited to spacer walls having various other compositions or component ratios. Additionally, in the present embodiment, coating material 302 is comprised of $Cr_2O_3$, however, the present embodiment is also well suited to the use of various other coating materials.

With reference still to the embodiment of FIG. 3, spacer wall 102 has a coating material 302 applied thereto with varying thickness. In this embodiment, the varying thickness of coating material 302 correspondingly varies with the energy of the electrons which may impinge spacer assembly 300 such that the combination of the secondary electron emission coefficient function of coating material 302 and the secondary electron emission coefficient function of underlying spacer wall 102 combine to provide a total secondary electron emission coefficient function having a value of at or near 1.0 where desired along spacer assembly 300. More specifically, when coating material 302 is deposited to a sufficient thickness, the secondary electron emission coefficient function will be that of coating material 302. Conversely, when no coating material 302 is present, the secondary electron emission coefficient function will be that of spacer wall 102. However, when coating material 302 is thin enough (e.g. at region 304), the secondary electron emission coefficient function will be comprised partially of the secondary electron emission coefficient function of coating material 302 and partially of the secondary electron emission coefficient function of underlying spacer wall 102. Thus, the present embodiment takes into account the fact that the energy of impinging electrons increases from a value of approximately 0 keV at the region near cathode 106 to a value of approximately 6 keV at the region near anode 108. The present embodiment then tailors the thickness of coating 302 such that the combination of the secondary electron emission coefficient function of coating material 302 and the secondary electron emission coefficient function of underlying spacer wall 102 will provide a total secondary electron emission coefficient function having a value at or near 1.0 where desired. Thus, the present embodiment generates a spacer assembly having a plurality of position varying secondary electron emission coefficient functions associated therewith.

Figure 4:
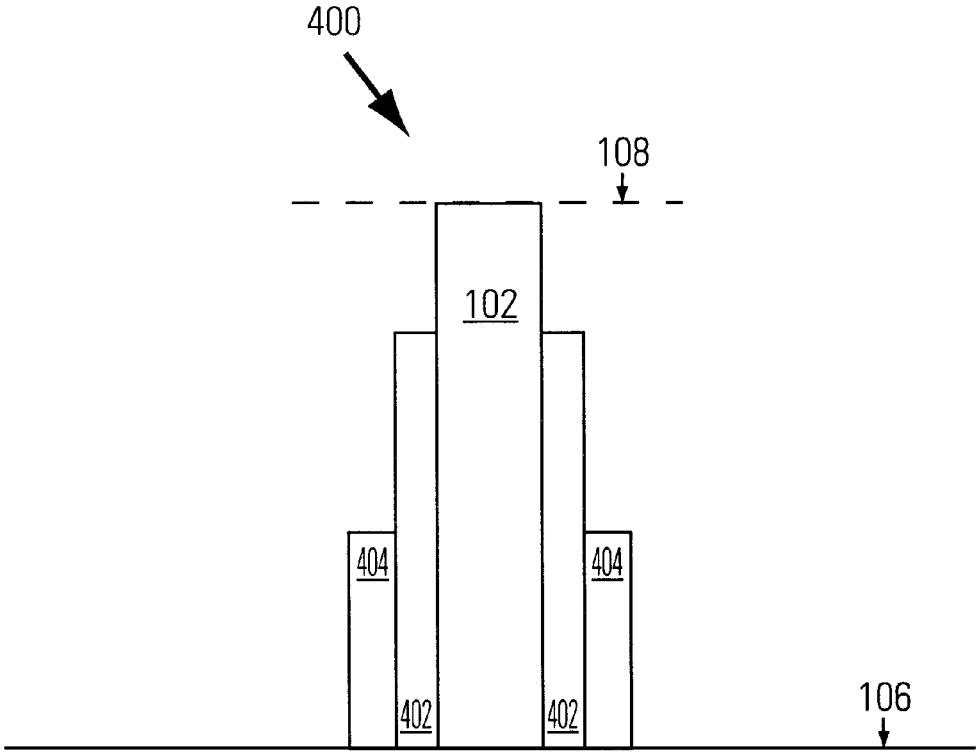
FIG. 4 is a side schematic view of a spacer assembly in which a spacer wall has a first coating material applied to a first portion thereof and a second coating material applied to a second portion thereof in accordance with one embodiment of the present claimed invention.

With reference now to FIG. 4, a side schematic view of a spacer assembly 400 is shown. In the present embodiment, a spacer wall 102 has a first coating material 402 applied to a first portion thereof and a second coating material 404 applied to a second portion thereof. In the embodiment of FIG. 4, spacer wall 102 is comprised of the same materials described in detail above in conjunction with the embodiment of FIGS. 1, 2A, and 3. However, the present invention is also well suited to spacer walls having various other compositions or component ratios. Additionally, in the present embodiment, second coating material 404 is comprised of $Cr_2O_3$, however, the present embodiment is also well suited to the use of various other coating materials. In the embodiment of FIG. 4, first coating material 402 is comprised of $Nd_2O_3$. As shown in FIG. 4, first coating material 402 is exposed only where impinging electrons will have an energy in the range of approximately 2–4 keV. Thus, by selecting a material (e.g. $Nd_2O_3$) which has a secondary electron emission coefficient function having a value of at or near 1.0 for such a potential range, the present embodiment tailors the overall secondary electron emission coefficient function to the desired value. That is, the present embodiment has a coating material 404 with a secondary electron emission coefficient function of at or near 1.0 for lower energies (e.g. 0–2 keV) disposed near cathode 106. The present embodiment then has a coating material 402 with a secondary electron emission coefficient function of at or near 1.0 for mid-range energies (e.g. 2–4 keV) disposed near the middle portion of spacer wall 102. Finally, the present embodiment has an exposed bare spacer wall 102 with a secondary electron emission coefficient function of at or near 1.0 for higher energies (e.g. 4–6 keV) disposed near anode 108. The present embodiment is also well suited to varying the location of, thickness of, or materials comprising the first and second coating to precisely tailor the resultant secondary electron emission coefficient function wherever desired along spacer assembly 400. Additionally, the present embodiment is also well suited to using more than two coating materials to achieve the desired resultant secondary electron emission coefficient function.

Figure 5:
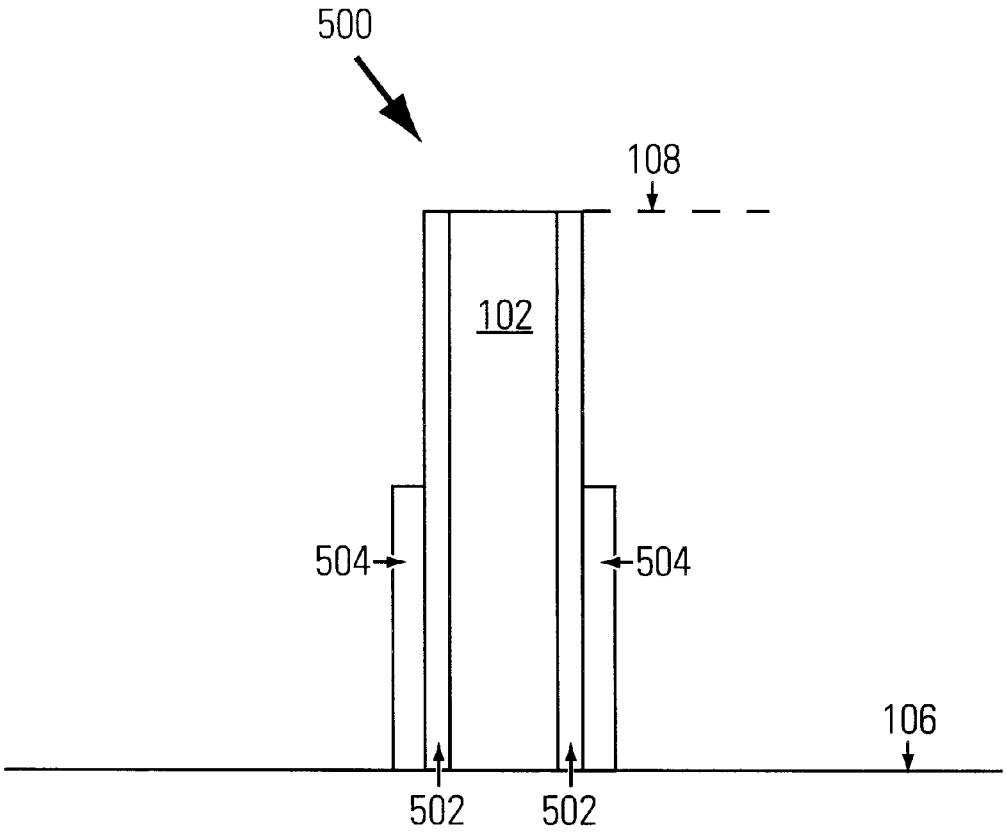
FIG. 5 is a side schematic view of a spacer assembly in which a spacer wall has a first coating material applied to a first portion thereof and a second coating material applied to a second portion thereof such that the entire spacer wall is coated in accordance with one embodiment of the present claimed invention.

With reference now to FIG. 5, a side schematic view of a spacer assembly 500 in which a spacer wall has a first coating material 502 applied to a first portion thereof and a second coating material 504 applied to a second portion thereof. In the embodiment of FIG. 5, the entire surface of spacer wall 102 is coated. In this embodiment, spacer wall 102 is comprised of the same materials described in detail above in conjunction with the embodiment of FIGS. 1, 2A, 3, and 4. However, the present invention is also well suited to spacer walls having various other compositions or component ratios. Additionally, in the present embodiment, second coating material 504 is comprised of $Cr_2O_3$, however, the present embodiment is also well suited to the use of various other coating materials. In the embodiment of FIG. 5, first coating material 502 is comprised of $Nd_2O_3$. As shown in FIG. 5, first coating material 502 is exposed only where impinging electrons will have an energy in the range of approximately 3–6 keV. Thus, by selecting a material (e.g. $Nd_2O_3$) which has a secondary electron emission coefficient function having a value of at or near 1.0 for such a potential range, the present embodiment tailors the overall secondary electron emission coefficient function to the desired value. That is, the present embodiment has a coating material 504 with a secondary electron emission coefficient function of at or near 1.0 for lower energies (e.g. 0–3 keV) disposed near cathode 106. The present embodiment then has a coating material 502 with a secondary electron emission coefficient function of at or near 1.0 for higher energies (e.g. 3–6 keV) disposed near anode 108. In this embodiment, none of bare spacer wall 102 is exposed. The present embodiment is also well suited to varying the location of, thickness of, or materials comprising the first and second coating to precisely tailor the resultant secondary electron emission coefficient function wherever desired along spacer assembly 500. Additionally, the present embodiment is also well suited to using more than two coating materials to achieve the desired resultant secondary electron emission coefficient function.

Figure 6:
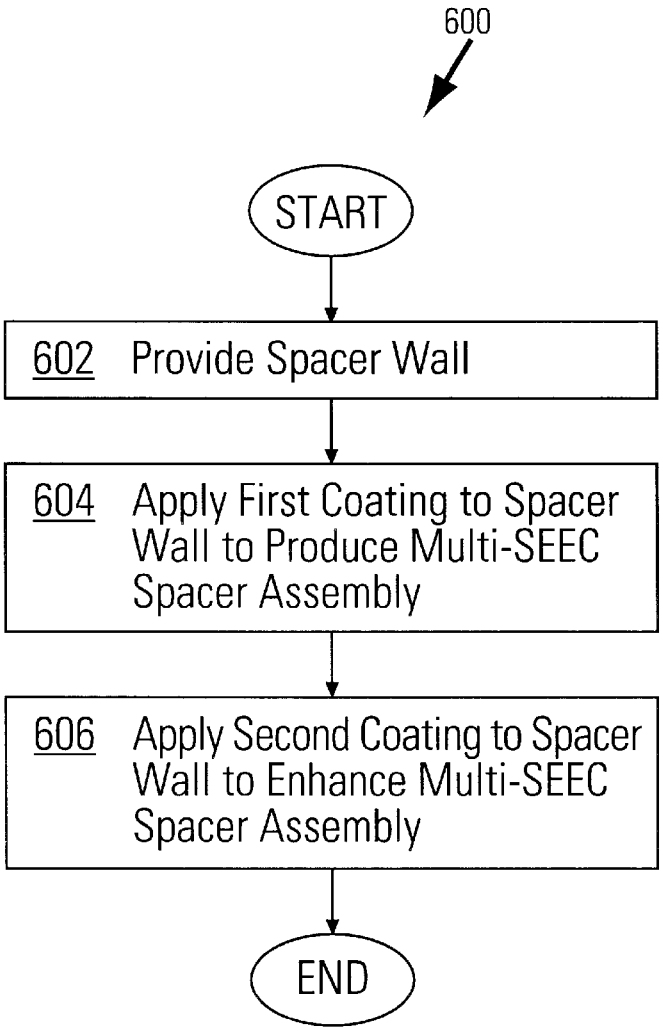
FIG. 6 is a flow chart of steps performed during the production of a spacer assembly in which a spacer wall has a first coating material applied to a first portion thereof and a second coating material applied to a second portion thereof in accordance with one embodiment of the present claimed invention.

With reference now to FIG. 6 a flow chart 600 of steps performed during the production of a spacer assembly in accordance with the present claimed invention is shown. As shown in FIG. 6, at step 602, the present invention first provides a spacer wall. In the present embodiment, the spacer wall (e.g. spacer wall 102 of FIGS. 1, 2A, 3, 4, and 5) is comprised of a combination of materials. More specifically, in the present embodiment spacer wall 102 is comprised of approximately 30 percent chromium oxide ($Cr_2O_3$), approximately 70 percent alumina ($Al_2O_3$), with a small amount of titanium (Ti) added as well. Although spacer wall 102 is comprised of such a mixture in the present embodiment, the present invention is also well suited to spacer walls having various other compositions or component ratios. Typically, spacer wall 102 will have a length (from cathode to anode) of 1.25 millimeters, and a width of 50 mils.

Next, at step 604, the present embodiment applies a first coating material (e.g. coating material 104 of FIG. 1) to spacer wall provided in step 602. In one embodiment, the coating material is comprised of $Cr_2O_3$. Furthermore, in the present embodiment, the coating material is applied to the underlying spacer wall with a thickness of approximately a few hundred Angstroms. It is within the scope of the present invention, however, to vary the thickness of the coating material. The present invention is also well suited to the use of various other coating materials which satisfy the conditions set forth above. Additionally, the present invention is well suited to varying the location on spacer wall 102 to which the coating material is applied. That is, the present invention is, for example, well suited to applying coating material proximate to where the spacer wall is coupled to a cathode of a field emission display device, and/or not applying the coating material proximate to where the spacer wall is coupled to an anode of a field emission display device.

Referring now to step 606, the present embodiment then applies a second coating material (e.g. coating material 404 of FIG. 4) to the spacer assembly. In one embodiment, the second coating material overlies a first coating material (e.g. coating material 402 of FIG. 4). In so doing, the present embodiment tailors the overall secondary electron emission coefficient function to a desired value. That is, the present embodiment has a coating material (e.g. the second coating material) with a secondary electron emission coefficient function of at or near 1.0 for lower energies (e.g. 0–3 keV) disposed near the cathode of the field emission display device. The present embodiment then has another coating material (e.g. the first coating material) with a secondary electron emission coefficient function of at or near 1.0 for higher energies (e.g. 3–6 keV) disposed near the anode of the field emission display device. The present embodiment is also well suited to varying the location of, thickness of, composition of, or materials comprising the first and second coating to precisely tailor the resultant secondary electron emission coefficient function wherever desired along the spacer assembly.

Figure 7:
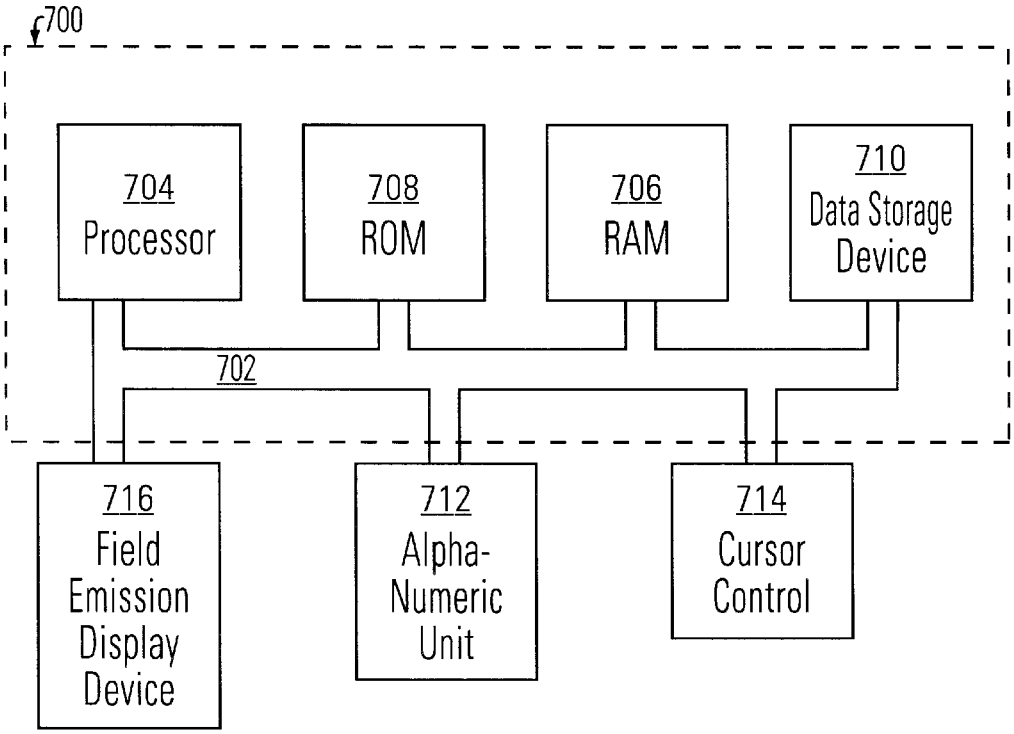
FIG. 7 is a schematic diagram of an exemplary computer system having a field emission display device in accordance with one embodiment of the present invention.

With reference now to FIG. 7, an exemplary computer system 700 used in accordance with the present embodiment is illustrated. It is appreciated that system 700 of FIG. 7 is exemplary only and that the present invention can operate within a number of different computer systems including personal computer systems, laptop computer systems, personal digital assistants, telephones (e.g. wireless cellular telephones), in-vehicle systems, general purpose networked computer systems, embedded computer systems, and stand alone computer systems. Furthermore, as will be described below in detail, the components of computer system 700 reside, for example, in a client computer and/or in the intermediate device coupled to computer system 700. Additionally, computer system 700 of FIG. 7 is well adapted having computer readable media such as, for example, a floppy disk, a compact disc, and the like coupled thereto. Such computer readable media is not shown coupled to computer system 700 in FIG. 7 for purposes of clarity.

System 700 of FIG. 7 includes an address/data bus 702 for communicating information, and a central processor unit 704 coupled to bus 702 for processing information and instructions. Central processor unit 704 may be, for example, an 80×86-family microprocessor or various other type of processing unit. System 700 also incudes data storage features such as a computer usable volatile memory 706, e.g. random access memory (RAM), coupled to bus 702 for storing information and instructions for central processor unit 704, computer usable non-volatile memory 708, e.g. read only memory (ROM), coupled to bus 702 for storing static information and instructions for the central processor unit 704, and a data storage unit 710 (e.g., a magnetic or optical disk and disk drive) coupled to bus 702 for storing information and instructions. System 700 of the present invention also includes an optional alphanumeric input device 712 including alphanumeric and function keys is coupled to bus 702 for communicating information and command selections to central processor unit 704. System 700 also optionally includes a cursor control device 714 coupled to bus 702 for communicating user input information and command selections to central processor unit 704. System 700 of the present embodiment also includes an field emission display device 716 coupled to bus 702 for displaying information.

Referring still to FIG. 7, optional cursor control device 714 allows the computer user to dynamically signal the two dimensional movement of a visible symbol (cursor) on a display screen of display device 716. Many implementations of cursor control device 714 are known in the art including a trackball, mouse, touch pad, joystick or special keys on alphanumeric input device 712 capable of signaling movement of a given direction or manner of displacement. Alternatively, it will be appreciated that a cursor can be directed and/or activated via input from alphanumeric input device 712 using special keys and key sequence commands. The present invention is also well suited to directing a cursor by other means such as, for example, voice commands.

Thus, the present invention provides a spacer structure which compensates for the variation in energy of the electrons which may potentially strike the spacer structure. The present invention further provides a spacer structure which accomplishes the above achievement and which does not degrade severely when subjected to electron bombardment. The present invention further provides a spacer structure which accomplishes both of the above-listed achievements and which does not significantly contribute to contamination of the vacuum environment of the flat panel display or be susceptible to contamination that may evolve within the tube.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In a field emission display device, a spacer assembly comprising:

a spacer structure having a secondary electron emission coefficient function, said spacer structure having a composition of approximately 30 percent $Cr_2O_3$, approximately 70 percent $Al_2O_3$, and less than approximately 1 percent of titanium present, such that contaminant carbon can be easily removed therefrom prior to field emission display sealing process; and a coating material applied to at least a portion of said spacer structure, said coating material having a secondary electron emission coefficient function which is different than said secondary electron emission coefficient function of said spacer structure such that said spacer assembly has a plurality of secondary electron emission coefficient functions associated therewith.

2. The spacer assembly of claim 1 wherein said coating material is applied to said at least a portion of said spacer structure proximate to where said spacer structure is coupled to a cathode of said field emission display device.

3. The spacer assembly of claim 1 wherein said coating material is not applied to said spacer structure proximate to where said spacer structure is coupled to an anode of said field emission display device.

4. The spacer assembly of claim 1 wherein said coating material is applied to said at least a portion of said spacer structure with varying thickness, said varying thickness of said coating material correspondingly varying said secondary electron emission coefficient function of said coating material such that said plurality of secondary electron emission coefficient functions of said spacer assembly vary corresponding to said thickness of said coating material applied to said at least a portion of said spacer structure.

5. The spacer assembly of claim 1 further comprising:

a second coating material applied to at least a first portion of said spacer assembly, said second coating material having a secondary electron emission coefficient function which is different than said secondary electron emission coefficient function of said spacer structure and which is different than said secondary electron emission coefficient function of said coating material.

6. The spacer assembly of claim 5 wherein said second coating material applied to said at least a first portion of said spacer assembly is disposed overlying at least a portion of said coating material.

7. The spacer assembly of claim 6 wherein said second coating material is disposed overlying said at least a portion of said coating material proximate to where said spacer structure is coupled to a cathode of said field emission display device.

8. The spacer assembly of claim 1 wherein said coating material is $Cr_2O_3$.

9. A flat panel display apparatus comprising:

a faceplate;

a backplate disposed opposing said faceplate, said faceplate and said backplate adapted to be connected in a sealed environment such that a low pressure region exists between said faceplate and said backplate; and a spacer assembly disposed within said sealed environment, said spacer assembly supporting said faceplate and said backplate against forces acting in a direction towards said sealed environment, said spacer assembly further comprising;

a spacer structure having a secondary electron emission coefficient function, said spacer structure having a composition of approximately 30 percent $Cr_2O_3$, approximately 70 percent $Al_2O_3$, and less than approximately 1 percent of titanium present, such that contaminant carbon can be easily removed therefrom prior to field emission display sealing process; and a coating material applied to at least a portion of said spacer structure, said coating material having a secondary electron emission coefficient function which is different than said secondary electron emission coefficient function of said spacer structure such that said spacer assembly has a plurality of secondary electron emission coefficient functions associated therewith.

10. The flat panel display apparatus of claim 9 wherein said coating material is applied to said at least a portion of said spacer structure proximate to where said spacer structure is coupled to said backplate of said flat panel display apparatus.

11. The flat panel display apparatus of claim 9 wherein said coating material is not applied to said spacer structure proximate to where said spacer structure is coupled to an anode of said flat panel display apparatus.

12. The flat panel display apparatus of claim 9 wherein said coating material is applied to said at least a portion of said spacer structure with varying thickness, said varying thickness of said coating material correspondingly varying said secondary electron emission coefficient function of said coating material such that said plurality of secondary electron emission coefficient functions of said spacer assembly vary corresponding to said thickness of said coating material applied to said at least a portion of said spacer structure.

13. The flat panel display apparatus of claim 9 further comprising:

a second coating material applied to at least a first portion of said spacer assembly, said second coating material having a secondary electron emission coefficient function which is different than said secondary electron emission coefficient function of said spacer structure and which is different than said secondary electron emission coefficient function of said coating material.

14. The flat panel display apparatus of claim 13 wherein said second coating material applied to said at least a first portion of said spacer assembly is disposed overlying at least a portion of said coating material.

15. The flat panel display apparatus of claim 14 wherein said second coating material is disposed overlying said at least a portion of said coating material proximate to where said spacer structure is coupled to a cathode of said flat panel display apparatus.

16. In a field emission display device, a method for forming a spacer assembly, said method comprising the steps of:

applying a coating material applied to at least a portion of a spacer structure, said spacer structure having a composition of approximately 30 percent $Cr_2O_3$, approximately 70 percent $Al_2O_3$, and less than approximately 1 percent of titanium present, such that contaminant carbon can be easily removed therefrom prior to field emission display sealing process, said coating material having a secondary electron emission coefficient function which is different than said secondary electron emission coefficient function of said spacer structure such that said spacer assembly has a plurality of secondary electron emission coefficient functions associated therewith.

17. The method as recited in claim 16 wherein said step of applying said coating material to said at least a portion of said spacer structure further comprises applying said coating material proximate to where said spacer structure is coupled to a cathode of said field emission display device.

18. The method as recited in claim 16 wherein said step of applying said coating material to said at least a portion of said spacer structure further comprises not applying said coating material to said spacer structure proximate to where said spacer structure is coupled to an anode of said field emission display device.

19. The method as recited in claim 16 wherein said step of applying said coating material to said at least a portion of said spacer structure further comprises applying said coating material to said at least a portion of said spacer structure with varying thickness, said varying thickness of said coating material correspondingly varying said secondary electron emission coefficient function of said coating material such that said plurality of secondary electron emission coefficient functions of said spacer assembly vary corresponding to said thickness of said coating material applied to said at least a portion of said spacer structure.

20. The method as recited in claim 16 further comprising the step of:

applying a second coating material to at least a second portion of said spacer assembly, said second coating material having a secondary electron emission coefficient function which is different than said secondary electron emission coefficient function of said spacer structure and which is different than said secondary electron emission coefficient function of said coating material.

21. The method as recited in claim 20 wherein said step of applying said second coating material to said at least a second portion of said spacer assembly further comprises applying said second coating material such that said second coating material overlies at least a portion of said coating material.

22. The method as recited in claim 21 wherein said step of applying said second coating material overlying said at least a portion of said coating material further comprises applying said second coating material proximate to where said spacer structure is coupled to a cathode of said field emission display device.

23. The method as recited in claim 16 wherein said step of applying said coating material to said at least a portion of said spacer assembly further comprises applying $Cr_2O_3$ to said at least a portion of said spacer assembly.

24. A computer system comprising:

a processor;

a bus coupled to said processor;

computer readable medium coupled to said bus and having stored therein instructions which when executed by said processor cause said computer system to operate; and a field emission display coupled to said processor for displaying information, said field emission display comprising:

a faceplate;

a backplate disposed opposing said faceplate, said faceplate and said backplate adapted to be connected in a sealed environment such that a low pressure region exists between said faceplate and said backplate; and a spacer assembly disposed within said sealed environment, said spacer assembly supporting said faceplate and said backplate against forces acting in a direction towards said sealed environment, said spacer assembly further comprising:

a spacer structure having a secondary electron emission coefficient function, said spacer structure having a composition of approximately 30 percent $Cr_2O_3$, approximately 70 percent $Al_2O_3$, and less than approximately 1 percent of titanium present, such that contaminant carbon can be easily removed therefrom prior to field emission display sealing process; and a coating material applied to at least a portion of said spacer structure, said coating material having a secondary electron emission coefficient function which is different than said secondary electron emission coefficient function of said spacer structure such that said spacer assembly has a plurality of secondary electron emission coefficient functions associated therewith.

25. The computer system of claim 24 wherein said coating material is applied to said at least a portion of said spacer structure proximate to where said spacer structure is coupled to said backplate of said flat panel display apparatus.

26. The computer system of claim 24 wherein said coating material is not applied to said spacer structure proximate to where said spacer structure is coupled to an anode of said flat panel display apparatus.

27. The computer system of claim 24 wherein said coating material is applied to said at least a portion of said spacer structure with varying thickness, said varying thickness of said coating material correspondingly varying said secondary electron emission coefficient function of said coating material such that said plurality of secondary electron emission coefficient functions of said spacer assembly vary corresponding to said thickness of said coating material applied to said at least a portion of said spacer structure.

28. The computer system of claim 24 further comprising:

a second coating material applied to at least a first portion of said spacer assembly, said second coating material having a secondary electron emission coefficient function which is different than said secondary electron emission coefficient function of said spacer structure and which is different than said secondary electron emission coefficient function of said coating material.

29. The computer system of claim 28 wherein said second coating material applied to said at least a first portion of said spacer assembly is disposed overlying at least a portion of said coating material.

30. The computer system of claim 28 wherein said second coating material is disposed overlying said at least a portion of said coating material proximate to where said spacer structure is coupled to a cathode of said flat panel display apparatus.

31. The computer system of claim 24 wherein said computer system is a personal computer.

32. The computer system of claim 24 wherein said computer system is a personal digital appliance.

33. The computer system of claim 24 wherein said computer system is a laptop computer.

34. The computer system of claim 24 wherein said computer system is a wireless cellular telephone computer.

* * * * *